United States Patent [19]

Davies et al.

[11] Patent Number: 4,959,977

[45] Date of Patent: Oct. 2, 1990

[54] MACHINE FOR AND METHOD OF PERFORMING A ROUGHING OPERATION PROGRESSIVELY ALONG MARGINAL PORTIONS OF A SHOE BOTTOM

[75] Inventors: John Davies, Syston; Herbert W. Boot, Thurmaston, both of England

[73] Assignee: British United Shoe Machinery Ltd., Leicester, England

[21] Appl. No.: 303,045

[22] Filed: Jan. 27, 1989

Related U.S. Application Data

[63] Continuation of Ser. No. 478,260, Mar. 24, 1983, abandoned.

[30] Foreign Application Priority Data

Apr. 8, 1982 [GB] United Kingdom ..... 8210488

[51] Int. Cl.[5] ..... C14B 1/44; C14B 17/04

[52] U.S. Cl. ..... 69/6.5; 69/21; 69/44

[58] Field of Search ..... 69/21, 40, 44, 6.5, 69/37

[56] References Cited

U.S. PATENT DOCUMENTS 3,559,428 2/1971 Babson ..... 69/6.5

3,645,118 12/1972 Babson ..... 69/6.5

4,391,011 7/1983 Peck et al. ..... 69/6.5 X 4,416,031 1/1983 Shutt et al. ..... 69/6.5 X

*Primary Examiner*—Wm. Carter Reynolds

*Attorney, Agent, or Firm*—Owen J. Meegan; Aubrey C. Brine

[57] ABSTRACT

A machine for progressively roughing marginal portions of shoe bottoms comprising a shoe support (18) having toe support means (470) and a heel support arrangement including two sets of clamps (390, 392), one set (392) of which serves also as sensing means for sensing, by engagement with an off-set portion of the shoe last whether the shoe thus supported is a left or a right. An inductance sensing device (610) associated with the second set of clamps (392) supplies a signal to control means of the machine, the signal being dependent upon whether the shoe is a left or a right. The control means ensures that, in the operation of the machine, a roughing operation is carried out on the shoe bottom in such a manner that the inside waist region of the shoe bottom is traversed always in the same directiion, regardless of whether the shoe is a left or a right (and of course similarly the outside waist region is consistently operated upon). In this way, uniformity of rough as between left and right shoes can be achieved.

12 Claims, 4 Drawing Sheets

MACHINE FOR AND METHOD OF PERFORMING A ROUGHING OPERATION PROGRESSIVELY ALONG MARGINAL PORTIONS OF A SHOE BOTTOM

This application is a continuation of Ser. No. 478,260, filed Mar. 24, 1983, now abandoned.

BACKGROUND OF THE INVENTION (1) Field of the Invention

This invention is concerned with a machine for performing a roughing operation progressively along marginal portions of a shoe bottom.

A progressively operating roughing machine is described in U.S. Pat. No. 4,391,011. The machine there described comprises two shoe supports whereby shoes supported by the shoe supports can be roughed one after the other.

In using this machine, left shoes could be supported by one shoe support and right shoes by the other so that shoes could be operated upon in pairs. In so using the machine, the amount of relative movement between the successively presented shoe supports and the tool supporting means is such that, in the case of each shoe of a pair thus presented, the roughing operation would take place along the inside waist region in the same direction (and thus of course the outside waist region of each shoe of the pair is similarly operated upon) so that, for a pair of shoes thus presented, the roughing operation is a mirror opposite for the left and right shoes, giving a desired uniformity of rough.

However, it is not essential that left shoes be loaded in one shoe support and right shoes in the other, but on the contrary, e.g. all the left shoes of a batch could first be operated upon, using both shoe supports, and thereafter all the right shoes. In such circumstances, it cannot be ensured that a left and a right shoe constituting a pair will be operated upon with the desired degree of uniformity of rough.

More especially, it will be appreciated that, as a roughing tool operates along a marginal portion of a shoe bottom in one direction, it will present to that shoe bottom a leading edge portion by which the roughing operation is essentially carried out, whereas when it operates progressively in an opposite direction, it will present an opposite leading edge portion. The roughing effect of each leading edge portion differs from that of the other in the roughing operation. Thus, in the case of a pair of shoes, in which the inside waist region of one of the shoes has been operated upon by a first leading edge portion and the insole waist region of the other of the pair of shoes has been operated upon by a different leading edge portion, the required uniformity cannot reliably be achieved.

Furthermore, especially in the case of high heeled shoes, there may be a tendency for a roughing tool traversing up an inclined marginal portion of the shoe bottom to "dig" into the material of the shoe bottom, while a tool traversing down such an inclined portion will tend to "bounce".

It is thus the object of the present invention to provide an improved roughing machine in which uniformity of rough can be achieved regardless of the sequence in which shoes are presented.

BRIEF SUMMARY OF THE INVENTION

The present invention comprises a machine wherein a signal can be supplied to the control means indicating whether the shoe next to be operated upon is a left or a right. The control means is effective to cause relative movement to be effected between the shoe support and tool supporting means that a roughing operation takes place along the inside waist region of the shoe bottom in the same direction regardless of whether the shoe is a left or a right.

In the operation of the machine in accordance with the invention, preferably the roughing operation takes place along the inside waist region in a direction from the heel end to the toe end of the shoe bottom. Thus, in the case of a high-heeled shoe, the roughing operation takes place as the roughing tool is caused to traverse up the inside waist region.

BRIEF DESCRIPTION OF THE DRAWINGS

There now follows a detailed description, to be read with reference to the accompanying drawings, of one machine in accordance with the invention. This machine has been selected for description merely by way of exemplification of the invention and not by way of limitation thereof.

In the accompanying drawings.

DESCRIPTION OF THE PREFERRED EMBODIMENT

Figure 1:
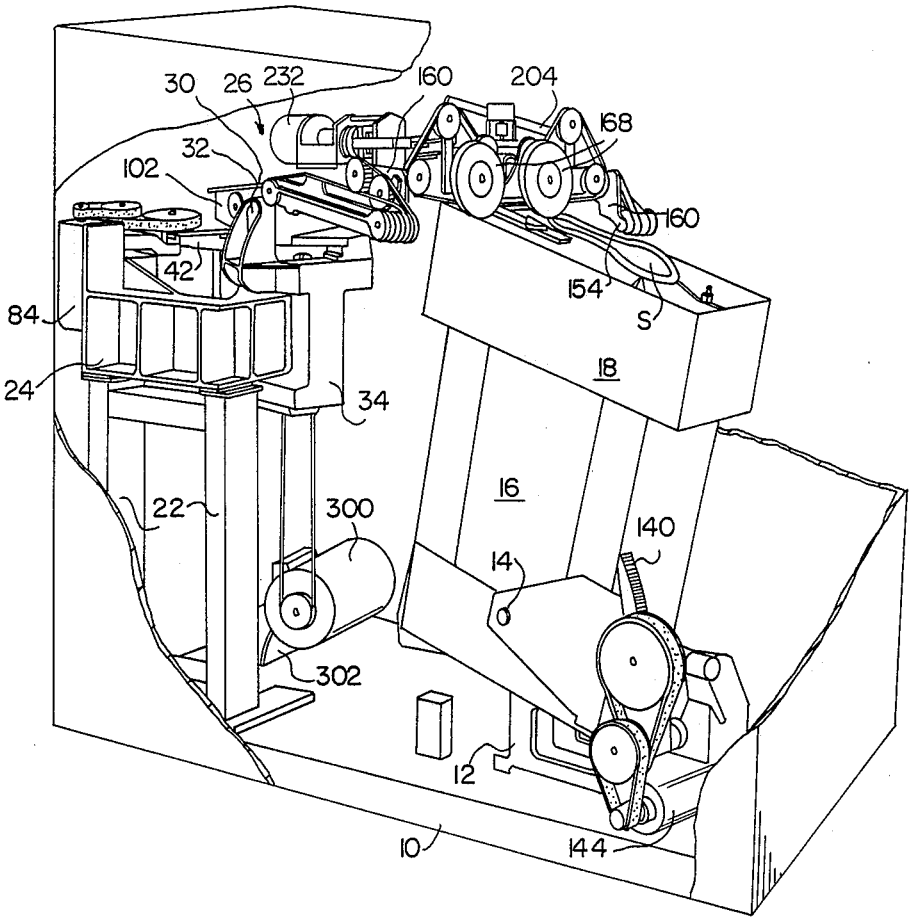
FIG. 1 is a left hand perspective view of the machine in accordance with the invention.

The machine comprises a base 10 (FIG. 1) supporting, by a bracket 12, a pivot shaft 14 about which a support 16 for the shoe support 18 can pivot. The shoe support is arranged to support a shoe S, bottom uppermost, with the toe end thereof facing toward the front of the machine, i.e. towards the operator.

At its rear, the base 10 supports a support column structure 22 carrying a casting 24 by which a tool support generally designated 26 is carried supporting two rotary radial roughing brushes 168 which are caused to rotate in opposite directions such that each brush effects an in-wiping action on the marginal portion of the bottom of a shoe as it is caused to operate progressively therealong. For causing rotation of the brushes, an electric motor 300, supported by a bracket 302 on the base 10, is operatively connected thereto through a series of belts and pulleys.

The tool support comprises a bifuricated arm 30 which is supported, for pivotal movement about a horizontal axis, in upstanding lugs 32, one arranged at either side of the arm 30, of a support casting 34, which is itself supported, above and below the casting 24, for pivotal movement about a vertical axis. It will thus, be appreciated that, in operation of the apparatus, the shoe support 18 can pivot about its shaft 14 to move a shoe S supported thereby in a direction extending generally lengthwise of the bottom of the shoe, while the tool supporting means is capable of pivotal movement about two axes thus to move the tools 168 supported thereby widthwise and heightwise of the shoe bottom, as the shoe support is moved.

For effecting such movements the apparatus comprises a first stepping motor 144 mounted on the base 10 and effective, through a series of pulleys and belts and through a toothed segment 140 mounted on its associated support structure 16, to cause pivotal movement of the shoe support 18 to take place about the horizontal axis of the shaft 14. Similarly, the apparatus comprises a second stepping motor 84, carried by the casting 24 and effective, through a series of pulleys and belts and through a toothed segment 42, to cause pivotal movement of the support casting 34, and thus of the arm 30 supported thereby, about a vertical axis on the casting 24. Again, the apparatus comprises a third stepping motor (not shown) which is supported by the support casting 34 rearwardly of its vertical pivot, and acts on a rearwardly extending portion 102 of the arm 30, thus to cause the arm 30 to pivot about a horizontal axis provided by the mounting of the arm in the support casting 34.

Figure 2:
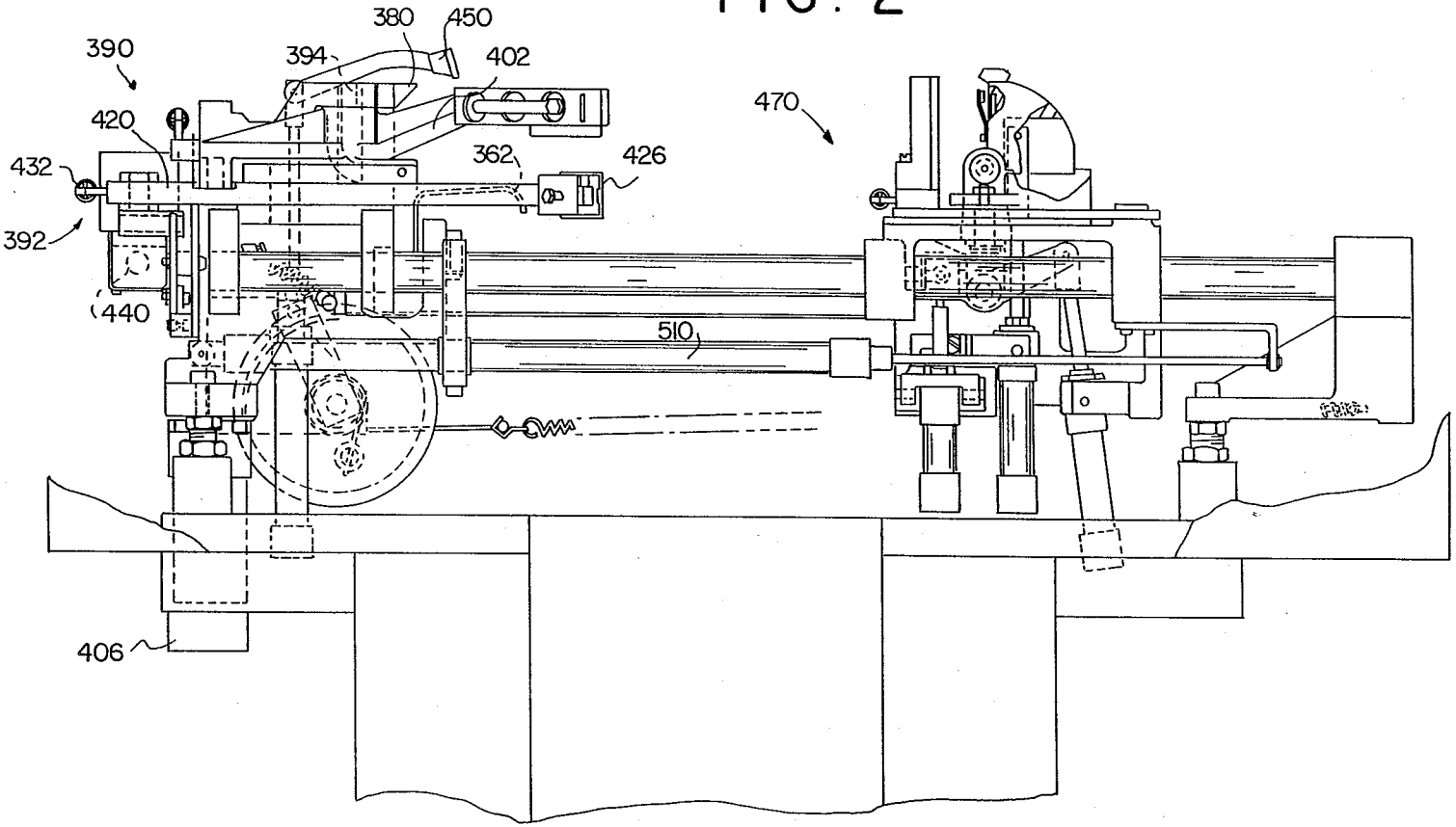
FIG. 2 is a left hand side view of a shoe support of the machine in accordance with the invention.

The arm 30 of the tool supporting means also supports, for pivotal movement thereon about a horizontal axis defined by pins 154, a cradle 160 (forming part of the tool supporting means) on which the tools 168 are carried, the horizontal axis being arranged to pass through the area of engagement between the operating surface of each brush 168 and the shoe bottom in the operation of the apparatus. Pivoting the cradle 160 in this manner enables the plane of the operating surface of each brush to be maintained normal, or substantially normal, to the shoe bottom portion being operated upon. For so pivoting the cradle, the apparatus comprises a fourth stepping motor 232 operatively connected by a rod 204 to the cradle 160. The shoe support 18 comprises a heel end support arrangement, comprising a shoe heel support member 362 which is spring-urged into an operative position (as shown in FIG. 2), and toe support means generally designated 470. The heel end support arrangement also comprises a hold-down 450, a heel abutment 380, providing a "back datum", and heel clamping means comprising a first set of clamps generally designated 390 and a second set of clamps generally designated 392. In the operation of the shoe support, a shoe is placed in the toe support means 470 thereby actuating a piston-and-cylinder arrangement 510, causing the toe support means 470 to move toward the heel end support arrangement, such movement being arrested by engagement of the heel end of the shoe with the abutment member 380, the holddown 450 then setting the heightwise position of the heel end of the shoe, which is urged thereagainst by the member 362.

The first set of clamps 390 of the heel clamping means are urged inwardly, towards one another about an axis 394, by means of a piston-and-cylinder arrangement 406, a piston rod 410 of which supports a wedge member 412. The latter acts, through rods 416, on rearward end portions of arms 402 by which the first set of clamps are carried. The first set of clamps are thus caused to move inwardly, each through the same distance, so that a shoe supported on the member 362 is centralized thereby, with the longitudinal center line of the heel portion of the shoe coincident with the longitudinal center line of the shoe support.

The second set of clamps 392 comprises two arms 420 each pivotable to move clamp members 426 inwardly into engagement with the shoe. End portions of the arms 420, remote from the clamp members, are connected by a spring 432, thus urging the clamping members outwardly. For urging the clamp members 426 inwardly the left hand arm (FIG. 3) has pivotally secured thereto a piston-and-cylinder arrangement 438, while a piston rod 440 of the arrangement 438 is pivotally connected to the right hand arm. Thus, admission of fluid under pressure to the arrangement 438 causes the clamp members 426 to be moved inwardly. Furthermore, by such arrangement, the clamping by the second set of clamps 392 is not symmetrical about to the longitudinal center line of the shoe support, but rather the clamping members 426 can accommodate themselves to the asymmetric shape of the shoe last in the top line region thereof.

Figure 3:
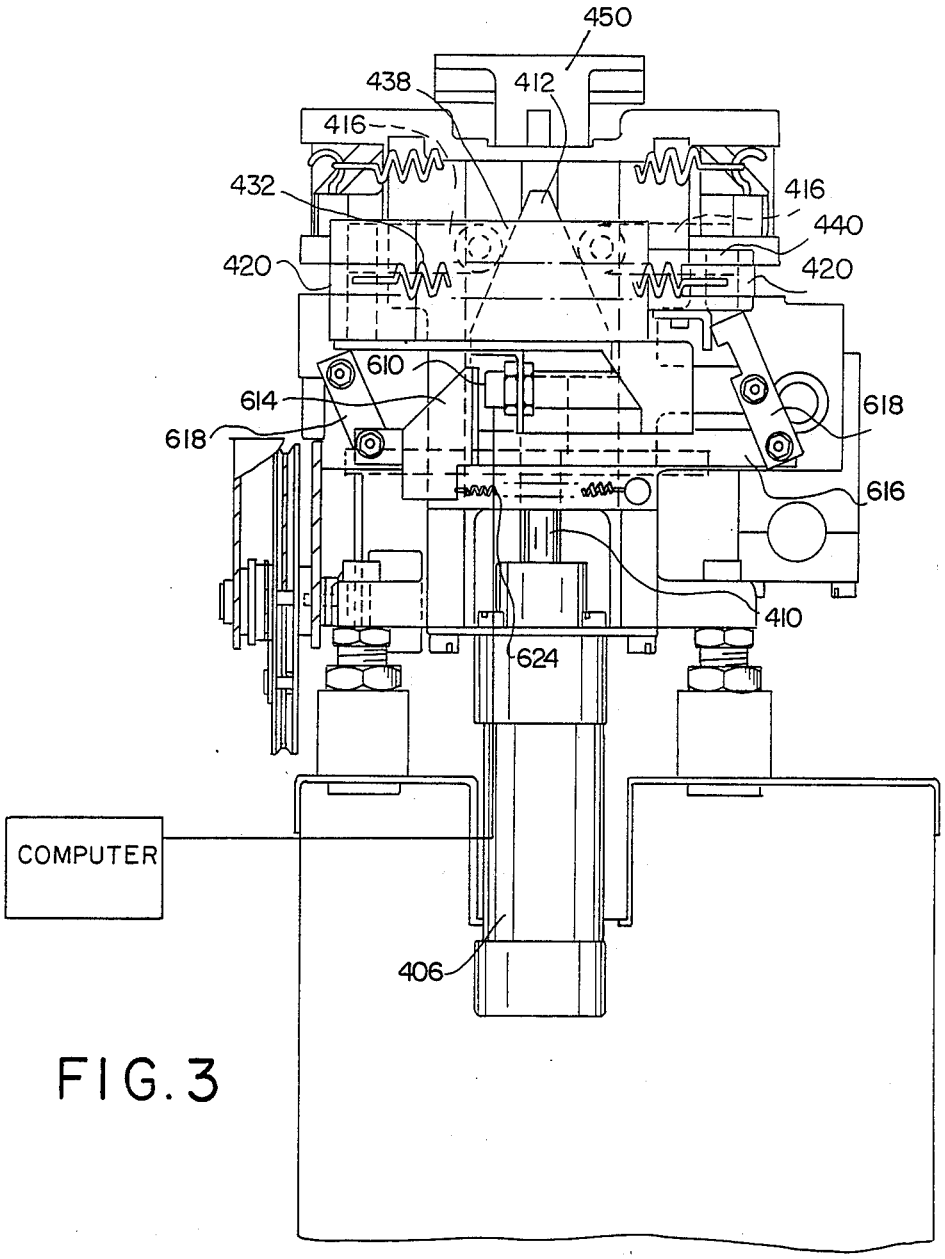
FIG. 3 is a rear view of the shoe support, showing details of sensing means thereof for sensing left and right shoes.

Because of the asymmetric (off-set) nature of the portion of the last engaged by the second set of clamp members 392, it can be determined whether the shoe supported in the shoe support is a left or a right. An inductance sensing device 610 shown in FIG. 3 is operatively connected to the piston-and-cylinder arrangement 438. Co-operating with the device 610 is a block 614 mounted on a rod 616 for sliding movement at the rear of the heel end support arrangement, rod 616 being supported by two parallel links 618, pivotally supported on a portion of a casting forming part of the heel end support arrangement. A spring 624 acts on the block 614 to urge it towards the sensing device 610. An upper end of the right hand link 618 also shown in FIG. 3, is arranged to abut with a stop face provided on the piston rod 440 of the piston-and-cylinder arrangement 438.

The inductance sensing device 610 provides two different signals, depending upon whether it is contacted by the block 614 or spaced therefrom. When a shoe is loaded in the shoe support, sensing whether such shoe is a left or a right, by means of the second set of clamps 392, is also effective through the parallel links 618, to vary the relative positions of the device 610 and the block 614. Thus, if a left shoe is clamped in the shoe support, the piston rod 440, in moving the right hand clamp member further inwardly, moves further to the right as seen in FIG. 3, than the longitudinal center line of the shoe support, thereby urging the block 614 away from the sensing device 610. If, on the other hand, a right shoe is clamped in the shoe support, the left hand clamp will move further inwardly, the piston-and-cylinder thus moving further to the left, as seen in FIG. 3, thereby carrying the sensor 610 into engagement with the block 614. Should such movement of the device continue after engagement with the block, the parallel link 618 can pivot, against the action of the spring 624, without risk of damage to the component parts.

The inductance sensing device 610 supplies an electrical signal to a computer, by which the operation of the machine is controlled, which signal depends upon whether the shoe sensed by the second set of clamps 392 is a left or a right. As described more fully in the aforementioned U.S. Pat. No. 4,391,011, the computer control means provides drive signals to the various stepping motors previously referred to in accordance with a programmed instruction, including digitized co-ordinate axis values using three co-ordinate axes, for a plurality of successive selected points along the marginal portion to be operated upon of a shoe bottom, so that the path of movement of the tools 168 in relation to the shoe bottom is determined according to the programmed instruction.

The programmed instruction by which the machine operation is thus controlled is arranged to ensure that, in operating upon the inside waist region of the shoe bottom, the shoe support is always moved in the same direction, and thus the direction in which the roughing operation progressively takes place on the inside waist region, is the same regardless of whether the shoe is a left or a right. Furthermore, in the machine now being described, the programmed instruction is so arranged that the roughing of the inside waist region takes place as a roughing tool 168 operates therealong in a direction from the heel end to the toe end, that is to say as the shoe support 18 is moved from its loading position into the machine. Thus, with a left shoe clamped in the shoe support 18, the left hand tool 168 is first caused to track along the right hand side of the shoe bottom, i.e. the inside waist region, and thereafter, when the left hand brush has reached the toe end, the right hand brush is moved into operating position in order to operate along the outside waist region, i.e. the left hand side of the shoe bottom, as the shoe support 18 is returned to its loading position. On the other hand, with a right shoe clamped in the shoe support 18, the right hand tool 168 is first caused to track along the left hand side of the shoe bottom, i.e. again the inside waist region, and thereafter, when the right hand tool has reached the toe end of the shoe, the left hand tool is brought into operation to operate upon the right hand side of the shoe bottom, i.e. the outside waist region. It will of course be appreciated that the determination as to the path of the roughing tools 168 in relation to the shoe bottom is dependent upon the sensing by the second set of clamps 392 as to whether the shoe is a left or a right, and upon an appropriate signal being accordingly supplied to the computer control means by the inductance sensing device 610 as shown in the chart depicted in FIG. 4.

Figure 4:
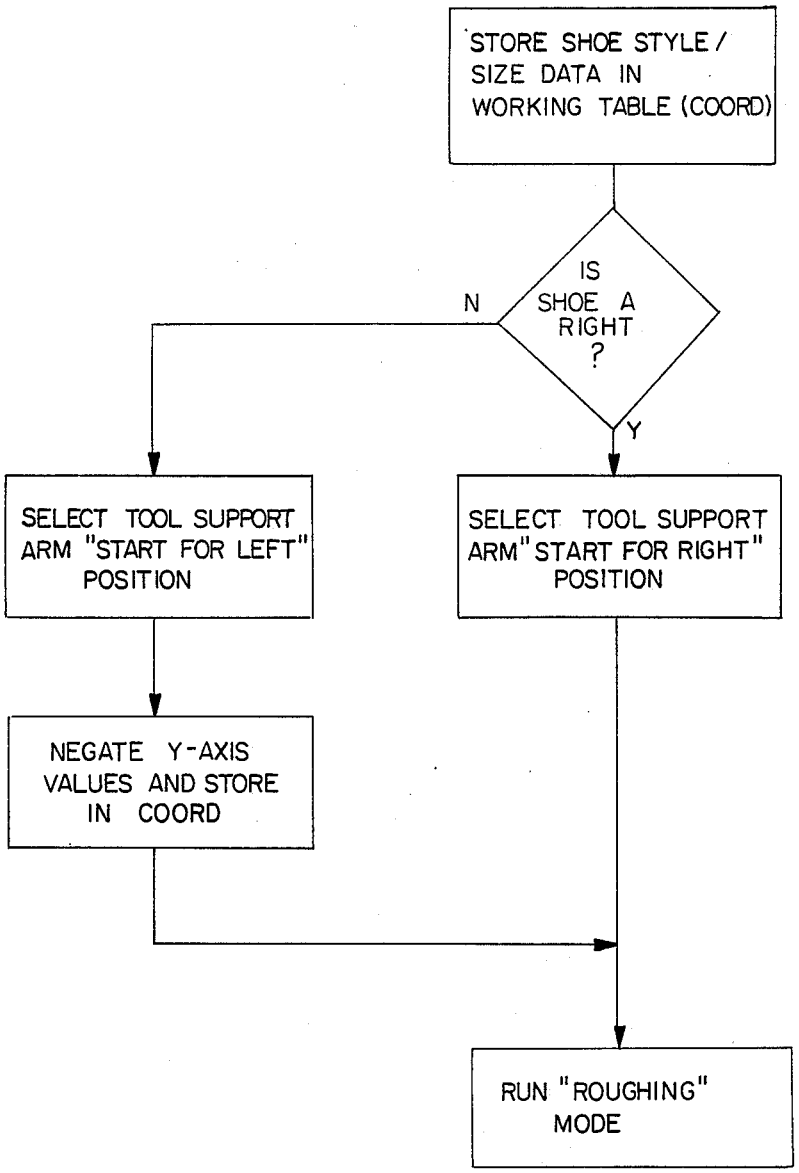
FIG. 4 is a flow chart showing the operational steps of the machine.

The programmed instruction by which the machine operation is thus controlled will now be described with reference to FIG. 4 showing a simple flow chart for machine operation. It will of course be appreciated that this programmed instruction is arranged to ensure that the function of the machine takes place as hereinbefore described, that is in operating upon the inside waist region of the shoe bottom, the shoe support is always moved in the same direction, and thus the direction in which the roughing operation progressively takes place on said inside waist region is the same regardless of whether the shoe is a left or a right; more particularly, the programmed instruction is so arranged that the roughing of the inside waist region takes place as one of the roughing tools 168 operates therealong in a direction from the heel end to the toe end, that is to say as the shoe support 18 is moved from its loading position into the machine, and thus the other of said tools 168 operate along the outside waist region in a direction from the toe end to the heel end, that is to say as the shoe support 18 returns to its loading position.

The programmed instruction utilizes stored shoe style and size data, as described in detail in U.S. Pat. No. 4,391,011, and the control of the movement of the tools is thus determined by this data, as there described. In the operation of the machine of the present invention, upon receipt of a signal from the inductance sensing device 610, the computer effectuates a step, which effectively is an enquiry as to the handedness of the shoe. It will be appreciated from FIG. 4 that in the machine now being described, the data stored in the working table (COORD) relates to a right, and is so set that in the case of a right shoe, the right-handed one of the roughing brushes 168 will first operate progressively along the inside waist region of the shoe, from the heel end to the toe end thereof, and thereafter, the left-hand brush 168 will operate along the outside waist region from the toe end to the heel end. Thus, if the answer to the initial step is "Yes", the unmodified data is selected and the "roughing" mode of the machine is executed.

If, on the other hand, the shoe is a left, as sensed by the inductance sensing device 610, then the tool support arm 30 is moved to a "start for left" position and the Y-axis values of the stored data are negated, thus to say given a negative value. These values are then stored in the working table (COORD) and thereafter the "roughing" mode of the machine is again executed. In this case, the left-hand one of the roughing brushes 168 first operates from the heel end of the shoe to the toe end along the inside waist region, and thereafter the right-hand brush 168 operates from the toe end back to the heel end along the outside waist region.

We claim:

1. A machine for performing a roughing operation progressively along marginal portions of a shoe bottom, comprising:

a shoe support;

means for supporting at least one roughing tool; and means, operable under the control of control means, for effecting relative movement between the shoe support and tool supporting means both lengthwise of the bottom of a shoe supported by the shoe support and widthwise thereof, such relative lengthwise movement being effected first in one direction and then in an opposite direction, whereby a roughing operation can be performed progressively first along the marginal portion of one side of a shoe bottom supported by the shoe support and then along the marginal portion of the opposite side of such shoe bottom, characterized in that signalling means is provided by which a signal can be supplied to the control means indicating whether the shoe next to be operated upon is a left or a right, and in response to a signal from which the control means is effective so to cause relative movement to be effected as aforesaid between the shoe support and tool supporting means that a roughing operation takes place along the inside waist region of the shoe bottom in the same direction regardless of whether the shoe is a left or a right.

2. A machine according to claim 1 wherein the roughing operation takes place along the insole waist region in a direction from the heel end to the toe end of the shoe bottom.

3. A machine according to claim 2 wherein sensing means is provided for sensing whether a shoe supported by the shoe support is a left or a right and for causing the signalling means to supply a signal accordingly to the control means as aforesaid.

4. A machine according to claim 3 wherein the shoe support comprises clamping means by which a shoe supported by said support is clamped, said clamping means also serving as the sensing means of the machine.

5. A machine according to claim 4 wherein the signalling means comprises an inductance sensing device associated with said clamping means, which device is responsive to changes in distance between itself and a co-operating element, the arrangement being such that the distance between said element and said device varies according to whether the shoe supported by the shoe support is a left or a right.

6. A machine for performing a roughing operation progressively along marginal portions of a shoe bottom, comprising:

a shoe support;

means for supporting at least one roughing tool; and means, operable under the control of control means, for effecting relative movement between the shoe support and tool supporting means both lengthwise of the bottom of a shoe supported by the shoe support and widthwise thereof, such relative lengthwise movement being effected first in one direction and then in an opposite direction, whereby a roughing operation can be performed progressively first along the marginal portion of one side of a shoe bottom supported by the shoe support and then along the marginal portion of the opposite side of such shoe bottom, characterized in that signalling means is provided by which a signal is supplied to the control means indicating whether the shoe next to be operated upon is a left or a right, and in response to a signal from which the control means is effective so to cause relative movement to be effected as aforesaid between the shoe support and tool supporting means that a roughing operation takes place along the inside waist region of the shoe bottom always in the same direction regardless of whether the shoe is a left or a right.

7. A machine according to claim 6 wherein the shoe supporting means and the tool supporting means have relative movement whereby the roughing operation is effectuated along the inside waist region in a direction from the heel and to the toe end of the shoe bottom.

8. A machine according to claim 7 wherein sensing means is provided for sensing whether a shoe supported by the shoe support is a left or a right and for causing the signalling means to supply a signal accordingly to the control means as aforesaid.

9. A method of roughing the marginal portions of a shoe bottom comprising the steps of:

providing means for supporting a shoe to be roughed, means for supporting at least one roughing tool, and means operable under a control means for effecting relative movement between the shoe supporting means and the tool supporting means both lengthwise and widthwise of a shoe bottom supported by the shoe support;

placing a shoe on the shoe support;

providing a signal to the control means indicating whether a shoe on the shoe support is a right shoe or a left shoe;

effecting said relative movement in one direction and then in an opposite direction first along the marginal portion of one side of the shoe bottom and then along the marginal portion of the opposite side of the shoe bottom, the control means causing the relative movement to take place along the inside waist region of the shoe bottom always in the same direction whether the shoe is a left shoe or a right shoe, as indicated to the control means by the signal.

10. A method as set forth in claim 9 wherein roughing is effectuated along the inside waist region in a direction from the heel end to the toe end of the shoe bottom.

11. A method as set forth in claim 9 wherein a sensing means is provided for sensing whether a shoe on the shoe support is a right shoe or a left shoe and wherein the signal provided to the control means is initiated by the sensing means.

12. A method as set forth in claim 10 wherein a sensing means is provided for sensing whether a shoe on the shoe support is a right shoe or a left shoe and wherein the signal provided to the control means is initiated by the sensing means.

* * * * *